US009768490B2

(12) United States Patent
Asai

(10) Patent No.: US 9,768,490 B2
(45) Date of Patent: Sep. 19, 2017

(54) IMAGE FORMING APPARATUS HAVING WIRELESS COMMUNICATION DEVICE

(71) Applicant: Brother Kogyo Kabushiki Kaisha, Nagoya-shi, Aichi-ken (JP)

(72) Inventor: Yasuhiro Asai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/645,530

(22) Filed: Mar. 12, 2015

(65) Prior Publication Data

US 2015/0263411 A1 Sep. 17, 2015

(30) Foreign Application Priority Data

Mar. 12, 2014 (JP) ..... 2014-049114

(51) Int. Cl.
*H01Q 1/22* (2006.01)

(52) U.S. Cl.
CPC ..... *H01Q 1/2216* (2013.01)

(58) Field of Classification Search
CPC .... H01Q 1/2216; H01Q 1/22; H04N 1/00347; H04N 2201/0013; H04N 1/00204
USPC ..... 358/1.15, 448
See application file for complete search history.

(56) References Cited

U.S. PATENT DOCUMENTS 5,765,093 A 6/1998 Funato
6,975,882 B2 12/2005 Goto
7,079,079 B2 * 7/2006 Jo ..... H01Q 1/243 343/700 MS
7,612,791 B2 11/2009 Sugimoto
7,764,236 B2 * 7/2010 Hill ..... H01Q 1/243 343/702
7,871,140 B2 1/2011 Ohama et al.
8,064,902 B2 11/2011 Kunii
8,140,036 B2 3/2012 Minami
9,089,064 B2 7/2015 Katsuyama et al.
9,116,490 B2 8/2015 Nakamura
9,131,086 B2 9/2015 Yuzawa
(Continued)

FOREIGN PATENT DOCUMENTS

CN 201928324 U 8/2011
EP 1182520 A2 2/2002
(Continued)

OTHER PUBLICATIONS

May 8, 2015—(EP) Extended Search Report—App 13161645.0.
(Continued)

*Primary Examiner* — Dameon E Levi
*Assistant Examiner* — Hasan Islam
(74) *Attorney, Agent, or Firm* — Banner & Witcoff, Ltd.

(57) ABSTRACT

An image forming apparatus includes a housing, a communication board, and a display device. The housing has an upper end portion, a front end portion, and a rear end portion. The front end portion and the rear end portion define a frontward/rearward direction. The communication board is provided on the upper end portion and includes an antenna for near field wireless communication. The display device is provided on the upper end portion. The display device and the antenna are arrayed on a straight line extending in the frontward/rearward direction such that the antenna is positioned frontward of the display device.

18 Claims, 9 Drawing Sheets

(56) References Cited

U.S. PATENT DOCUMENTS

| | | | | |
|---|---|---|---|---|
| 2003/0054859 | A1 | 3/2003 | Goto | |
| 2005/0206667 | A1 | 9/2005 | Ohama et al. | |
| 2007/0014620 | A1 | 1/2007 | Sugimoto | |
| 2007/0019215 | A1 | 1/2007 | Yu | |
| 2007/0041036 | A1* | 2/2007 | Nakayama | H04N 1/00204 358/1.15 |
| 2007/0223055 | A1 | 9/2007 | Moribe | |
| 2008/0012771 | A1 | 1/2008 | Watanabe | |
| 2008/0204801 | A1 | 8/2008 | Kunii | |
| 2008/0291283 | A1 | 11/2008 | Achiwa et al. | |
| 2009/0184817 | A1 | 7/2009 | Ishizuka | |
| 2010/0190445 | A1 | 7/2010 | Minami | |
| 2010/0277763 | A1 | 11/2010 | Aoyama et al. | |
| 2012/0092714 | A1 | 4/2012 | Suzuki | |
| 2012/0262749 | A1 | 10/2012 | Yamamoto | |
| 2012/0322461 | A1* | 12/2012 | Ito | G06F 21/35 455/456.1 |
| 2012/0329392 | A1 | 12/2012 | Matoba et al. | |
| 2013/0141758 | A1* | 6/2013 | Yoneda | G03G 15/5066 358/1.15 |
| 2013/0286433 | A1 | 10/2013 | Matsushima et al. | |
| 2013/0324056 | A1* | 12/2013 | Maguire | H01Q 1/245 455/73 |
| 2014/0132652 | A1 | 5/2014 | Nakamura | |
| 2015/0029540 | A1* | 1/2015 | Jo | G06F 3/1209 358/1.15 |

FOREIGN PATENT DOCUMENTS

| | | | |
|---|---|---|---|
| JP | H09-245985 | A | 9/1997 |
| JP | 2001-016026 | A | 1/2001 |
| JP | 2002-225390 | A | 8/2002 |
| JP | 2003-091409 | A | 3/2003 |
| JP | 2004-330595 | A | 11/2004 |
| JP | 2005-227712 | A | 8/2005 |
| JP | 2005-354300 | A | 12/2005 |
| JP | 2006-053477 | A | 2/2006 |
| JP | 2007-021767 | A | 2/2007 |
| JP | 2007-081509 | A | 3/2007 |
| JP | 2008-009293 | A | 1/2008 |
| JP | 2008-123476 | A | 5/2008 |
| JP | 2008-219199 | A | 9/2008 |
| JP | 2009-160936 | A | 7/2009 |
| JP | 2010-000616 | A | 1/2010 |
| JP | 2010-023526 | A | 2/2010 |
| JP | 2010-177938 | A | 8/2010 |
| JP | 2011-103572 | A | 5/2011 |
| JP | 2011-193393 | A | 9/2011 |
| JP | 2013-228540 | A | 11/2013 |

OTHER PUBLICATIONS

Sep. 18, 2015—(US)—Non-Final Office Action—U.S. Appl. No. 14/824,199.

Sep. 22, 2015—(US)—Non-Final Office Action—U.S. Appl. No. 13/852,795.

Feb. 2, 2016—(JP) Notice of Reasons for Rejection—App 2012-100080, Eng Tran.

Mar. 8, 2016—(JP) Office Action—App 2012-247461, Eng Tran.

Aug. 28, 2014—(US) Non-Final Office Action—U.S. Appl. No. 13/852,795.

Dec. 3, 2014—(US) Non-Final Office Action—U.S. Appl. No. 14/039,747.

Jan. 13, 2015—(US) Final Office Action—U.S. Appl. No. 13/852,795.

Dec. 3, 2015—(CN) Notification of First Office Action—App 201310450047.3, Eng Tran.

Sep. 30, 2015—(CN) The Second Office Action—App 201310146433.3, Eng Tran.

Jan. 6, 2016—(CN) The Third Office Action—App 201310146433.3, Eng Tran.

May 6, 2016—(US) Final Office Action—U.S. Appl. No. 13/852,795.

Jul. 19, 2016—(JP) Notice of Reasons for Rejection—App 2012-100080.

Jun. 21, 2016—(JP) Decision of Refusal—App 2012-247461.

Jul. 27, 2016—(US) Notice of Allowance—U.S. Appl. No. 13/852,795.

Jan. 27, 2017—(US) Non-Final Office Action—U.S. Appl. No. 15/163,358.

Jan. 27, 2017—(JP) Office Action—App 2014-049114, Eng Tran.

Jul. 25, 2017—(JP) Decision of Rejection—App 2014-049114, Eng Tran.

* cited by examiner

IMAGE FORMING APPARATUS HAVING WIRELESS COMMUNICATION DEVICE

CROSS REFERENCE TO RELATED APPLICATION

This application claims priority from Japanese Patent Application No. 2014-049114 filed Mar. 12, 2014. The entire content of the priority application is incorporated herein by reference.

TECHNICAL FIELD

This invention relates to an image forming apparatus that includes an antenna for wireless communication and a display device.

BACKGROUND

Japanese Patent Application Publication No. 2002-225390 discloses image forming apparatuses that include an antenna for wireless communication and a display device.

SUMMARY

In recent years, among these types of image forming apparatuses which include an antenna for wireless communication and a display device, there has been an increase in those which include an antenna for near field wireless communication.

Along with the increase in these types of image forming apparatuses, there has also been an increase in cases in which information displayed on a personal terminal, such as printing-related information displayed on the display device of a smartphone, or a user ID appearing on an authentication card. The information is confirmed when the portable terminal is placed over the antenna, while information displayed on the display device of the image forming apparatus is also confirmed.

When performing operations of this sort, if the antenna provided on the image forming apparatus and the display device provided on the image forming apparatus are far apart, users must shift their line of sight widely in order to confirm the information displayed on the personal terminal and the information displayed on the display device of the image forming apparatus, thus risking a decrease in operational efficiency.

Meanwhile, if the antenna provided on the image forming apparatus and the display device provided on the image forming apparatus are close together, the display device may, depending on the respective locations at which the antenna and the display device are disposed, be covered up by for instance the portable terminal being held to the antenna, the user's hand, or a strap attached to the portable terminal, thus risking a decrease in operational efficiency.

Therefore, the object of the present invention is to provide an image forming apparatus for which a display device and an antenna for near field wireless communication are positioned so as to prevent a decrease in operational efficiency.

In order to attain the above and other objects, the present invention provides an image forming apparatus that includes a housing, a communication board, and a display device. The housing may have an upper end portion, a front end portion, and a rear end portion. The front end portion and the rear end portion may define a frontward/rearward direction. The communication board may be provided on the upper end portion and includes an antenna for near field wireless communication. The display device may be provided on the upper end portion. The display device and the antenna may be arrayed on a straight line extending in the frontward/rearward direction such that the antenna is positioned frontward of the display device.

DETAILED DESCRIPTION

First Embodiment

Figure 1:
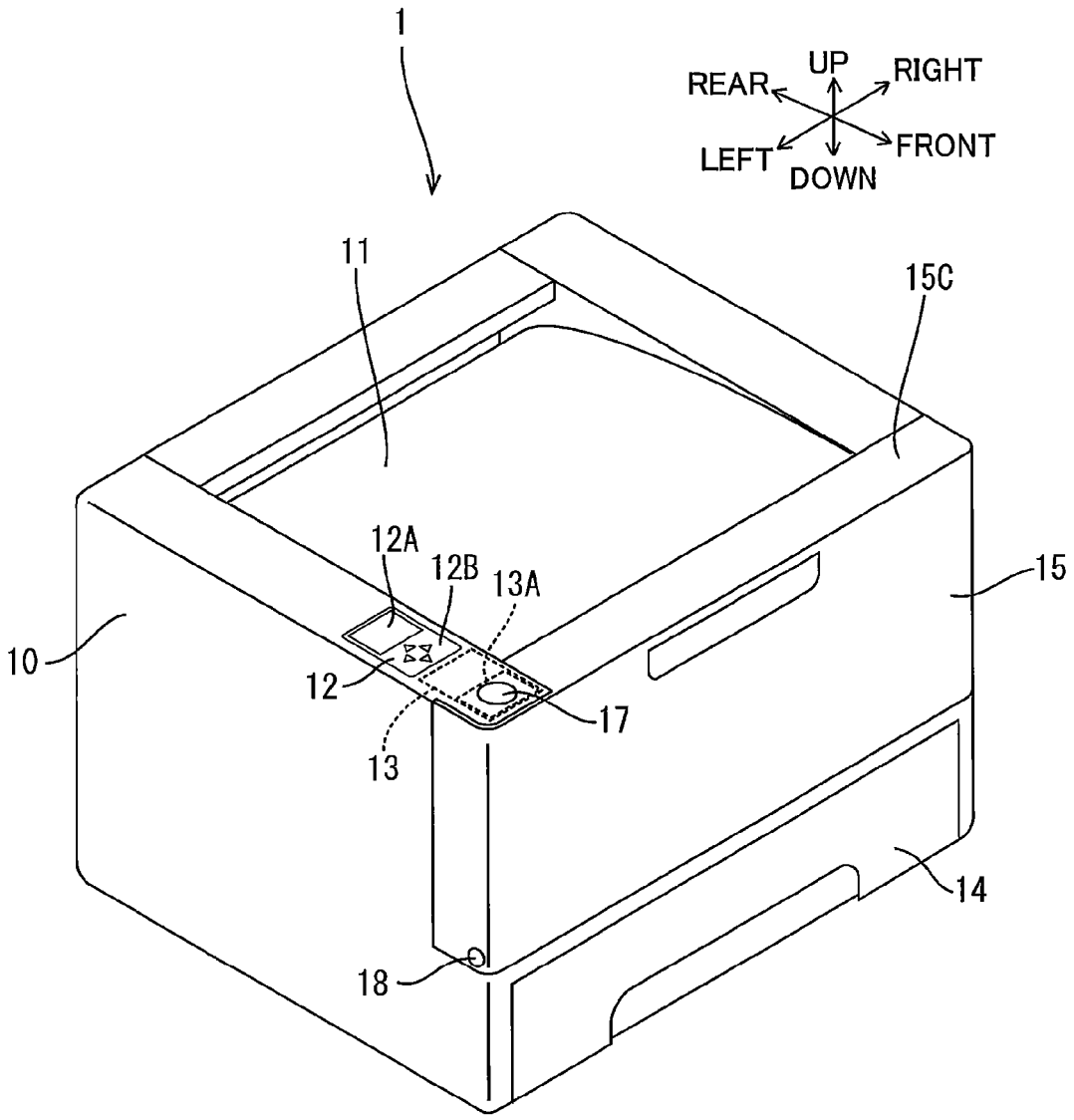
FIG. 1 is a perspective view of a printer according to one embodiment of the present invention.

A first embodiment will now be described with reference to FIGS. 1 to 8.

(1) Function of the Printer

First, a printer 1 will be described schematically as an image forming apparatus according to the first embodiment. The printer 1 is configured to be connectible to external devices such as personal computers through a communication interface unit 34 (see FIG. 4), described below, and to form images on sheets based on image forming jobs received from the external devices.

In addition, the printer 1 is configured to perform near field wireless communication, at short distances of up to approximately 10 centimeters (cm), with portable terminals such as smartphones and authentication cards. Near field wireless communication can be utilized for purposes such as (a) to (c) below. Note that the manner in which near field wireless communication is utilized can be freely decided as appropriate.

(a) Sending authentication information from the portable terminals to the image forming apparatus.

(b) Sending image forming jobs from the portable terminals to the image forming apparatus.

(c) Operating the image forming apparatus from the portable terminals.

With the present embodiment, examples are described in which near field communication (hereafter, NFC) is utilized as the near field wireless communication types described above. NFC is an international standard for near field wireless communication, advised as ISO/IEC 21481, ISO/IEC 18092, etc. Wireless communication generally includes radio wave types and electromagnetic induction types; NFC performs wireless communication using an electromagnetic induction type.

Next, the exterior of the printer 1 will be described. The printer 1 has a housing 10 made of resin. The housing 10 is formed into a substantially box-like shape with an opening in an upper portion. Connected to the housing 10 is an opening/closing cover 11 which opens and closes the opening. The opening/closing cover 11 is provided in order to allow users to perform maintenance operations such as replacing toner, ink, and the like. The opening/closing cover 11 is one of a number of parts which compose the housing 10. Here, the upper portion of the housing 10 refers to a part which forms an upper wall of the housing 10.

At the upper portion of the housing 10, an operating panel 12 is provided at a left side of the opening/closing cover 11. The operating panel 12 includes for instance a display device 12A such as a liquid crystal display, and various operation buttons 12B. The display device 12A has a display portion and a touch sensor which detects that an object has touched the display portion. In the description hereafter, the display device 12A with the touch sensor will be referred to as the touch screen 12A.

Users can specify various settings by manipulating the touch screen 12A and the operation buttons 12B. In addition, when a user holds a portable terminal near an antenna 13A for near field wireless communication, the touch screen 12A displays information to indicate whether or not near field wireless communication has been established successfully.

As shown in FIG. 1, a communication board 13 that includes the antenna 13A for near field wireless communication is provided at the upper portion of the housing 10 further toward a front side than the operating panel 12. Here, the "front side" refers to a side at which users are expected to operate the printer 1; in general, a printer has a side at which users are expected to operate. Text displayed on a display device is displayed so as to be correctly read when the printer is viewed from the side at which users are expected to operate the printer, and text written on operation buttons is written so as to be correctly read when the printer is viewed from the side at which users are expected to operate the printer. In other words, a printer has a front side and a rear side, and the location of the front side can be unambiguously identified based on the orientation of the text displayed on the display device and the text written on the operation buttons.

In addition, as will be described in detail below, the antenna 13A is covered by a protective cover 50 (see FIG. 7) and cannot be seen directly by users. For this reason, the printer 1 is configured such that a circular area 17 at an inner side of the antenna 13A illuminates, and based on this light a user can ascertain the location of the antenna 13A.

A sheet tray 14 that accommodates sheets and that can be pulled out is disposed on a lower side at a front surface of the housing 10. In addition, a front cover 15 is provided at the front surface of the housing 10 and upward of the sheet tray 14. The front cover 15 is utilized as a manual feed tray for loading sheets used for printing. For example, if a user wishes to form an image on a sheet of a different type than that of sheets accommodated in the sheet tray 14, the user can open the front cover 15 and load the sheets of the different type.

Figure 2:
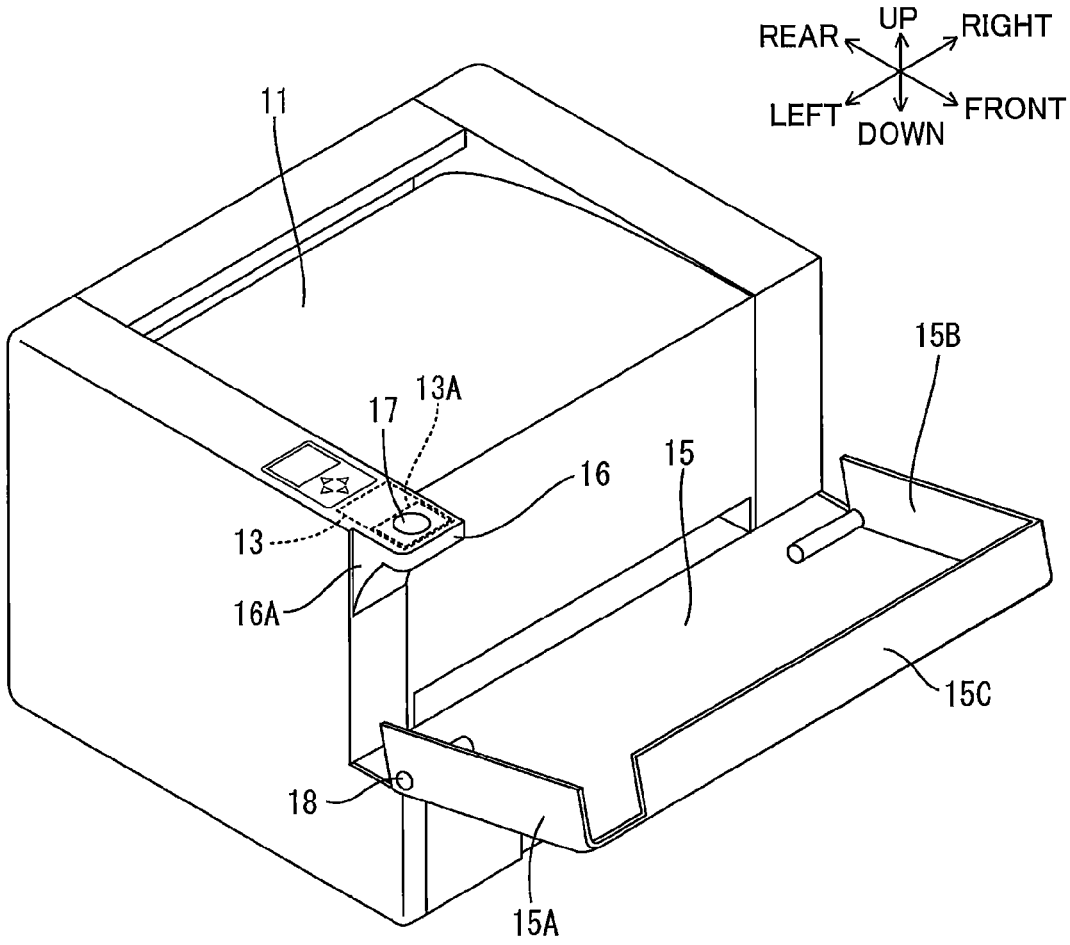
FIG. 2 is a perspective view of the printer with a front cover opened according to the embodiment.

FIG. 2 shows the printer 1 with the front cover 15 open. As shown in FIG. 2, a protruding portion 16 is integrally formed to, and protrudes forward from an upper left portion of, the housing 10. Meanwhile, a rib 16A is integrally formed to a lower surface of the protruding portion 16 in order to strengthen the protruding portion 16. As shown in FIG. 2, the antenna 13A is positioned on the protruding portion 16. The reason that the protruding portion 16 is provided is described below.

The front cover 15 has a left wall 15A at a left edge of a front wall that forms the front surface of the housing 10 and similarly a right wall 15B is provided at a right edge of the wall. At the left wall 15A and the right wall 15B, hinges 18 are respectively provided to connect the front cover 15 to the housing 10. The front cover 15 is pivotably movable about the hinges 18.

The front cover 15 has an upper surface portion 15C at an upper edge of the wall forming the front surface of the housing 10. When the front cover 15 is closed, the upper surface portion 15C extends from an upper edge of the front cover 15 toward a rear side of the housing 10. The left side of the upper surface portion 15C has a missing a portion conforming to the shape of the protruding portion 16. For this reason, when the front cover 15 is closed, as shown in FIG. 1, the upper surface portion 15C of the front cover 15 conforms to the protruding portion 16 so as to avoid collision with the protruding portion 16, and the front cover 15 can be closed without interfering with the protruding portion 16.

The reason that the upper surface portion 15C described above is provided is as follows. The left wall 15A and the right wall 15B are provided at the front cover 15 in order to attach the hinges 18 as described previously. Accordingly, if the upper surface portion 15C were not provided, an upper side of the front cover 15 would be uncovered when the front cover 15 is closed.

Next, the reason that the protruding portion 16 is provided will be described. The protruding portion 16 is provided in order to allow the antenna 13A to be disposed at the front side despite the fact that the front cover 15 includes the upper surface portion 15C. If the antenna 13A were to be provided at the upper surface portion 15C of the front cover 15, wires extending from the communication board 13 would descend to the vicinity of the hinges 18 and then be connected to the housing 10, and would thus become quite long. For this reason, it is preferable to provide the antenna 13A at the housing 10. If the protruding portion 16 had not been provided, the antenna 13A would have been disposed further toward the rear side of the housing 10 than the upper surface portion 15C is. In turn, if the antenna 13A were to be disposed further toward the rear side of the housing 10, the antenna 13A would be further from the front side of the housing 10. Therefore, the antenna 13A would be further away from a user holding a portable terminal, and thus it would be more difficult for the user to hold the portable terminal over the antenna 13A. Moreover, information displayed on the portable terminal would be harder to confirm since the portable terminal would be held further from the user. By contrast, by providing the protruding portion 16 and by also forming the upper surface portion 15C so as to avoid interference with the protruding portion 16, the antenna 13A can be positioned further toward the front side even if the upper surface portion 15C of the front cover 15 is provided.

(2) Internal Structure of the Printer

Figure 3:
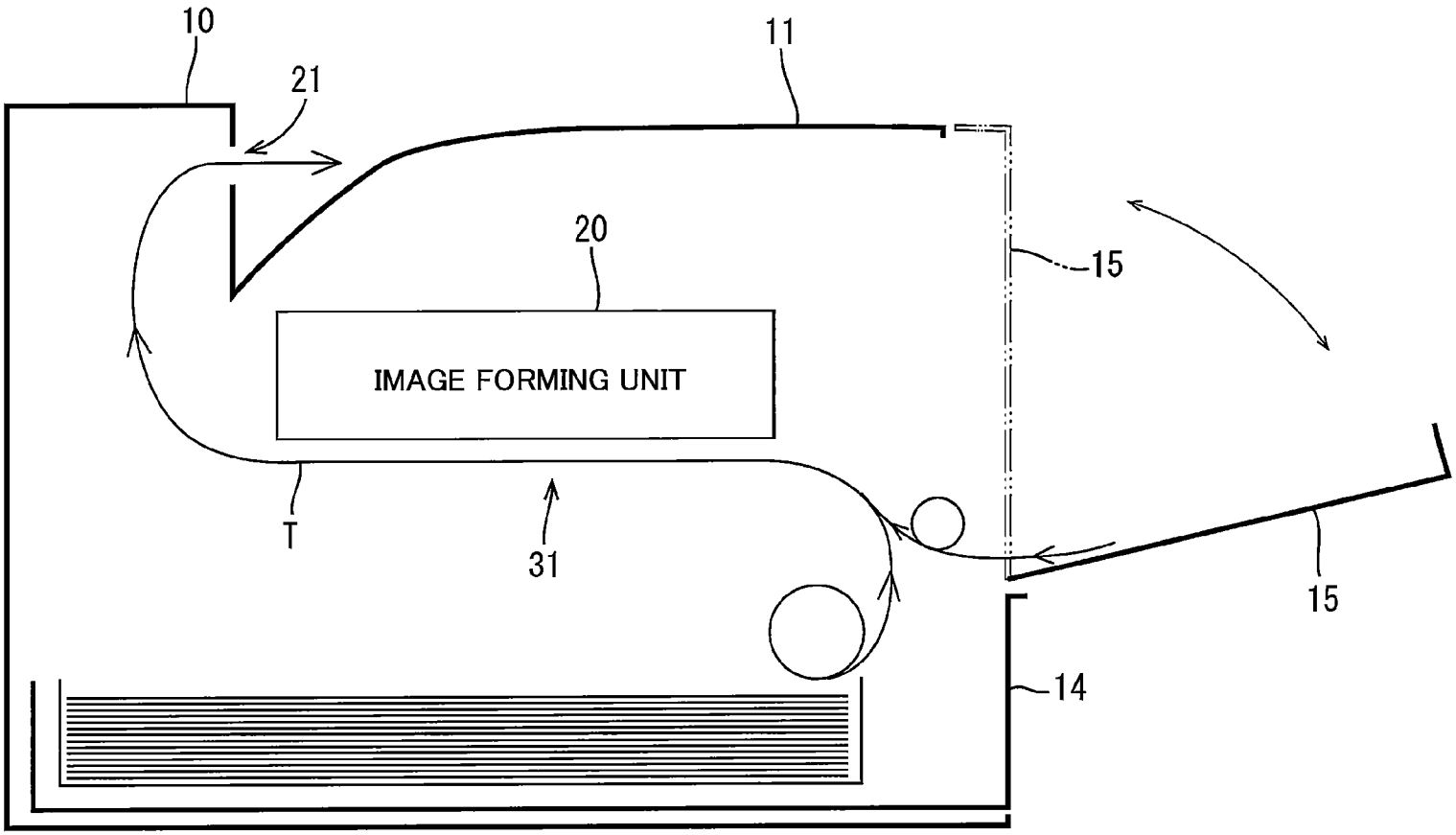
FIG. 3 is a simplified cross-sectional view of the printer showing a structure of the printer.

Next, the internal structure of the printer 1 will be described with reference to FIG. 3. The printer 1 is configured to include, the sheet tray 14, an image forming unit 20, and a conveying unit 31.

The conveying unit 31 includes multiple conveying rollers (not shown), a motor (not shown) which rotates these conveying rollers. The conveying rollers convey sheets accommodated in the sheet tray 14 and sheets loaded into the front cover 15 along a conveyance path T one by one. The image forming unit 20 forms images on sheets conveyed by the conveying unit 31 using, for instance, an electrophotographic method or an ink jet method. Sheets onto which images have been formed by the image forming unit 20 are discharged from a discharge port 21 and onto the opening/closing cover 11.

(3) Electrical Structure of the Printer

Figure 4:
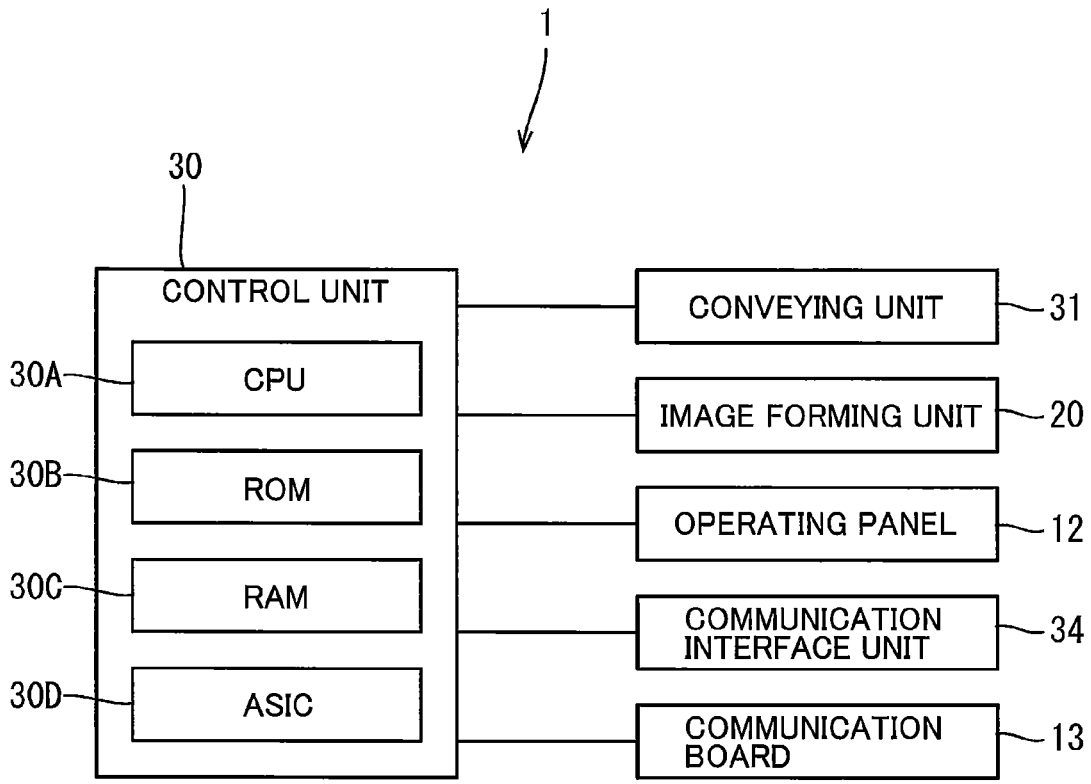
FIG. 4 is a block diagram that indicates an electrical configuration of the printer.

Next, the electrical configuration of the printer 1 will be described with reference to FIG. 4. The printer 1 includes, a control unit 30, the conveying unit 31, the image forming unit 20, the operating panel 12, the communication interface unit 34, and the communication board 13. The structure of the conveying unit 31, the image forming unit 20, and the operating panel 12 are as described previously, and are thus not described here.

The control unit 30 is configured to include such components as a CPU 30A, a ROM 30B, a RAM 30C, and an ASIC 30D. The CPU 30A controls various parts of the printer 1 by executing control programs stored in the ROM 30B. Control programs executed by the CPU 30A, a variety of data, and the like are stored in the ROM 30B. The RAM 30C is utilized as a main storage device for the execution of processes by the CPU 30A.

The communication interface unit 34 is hardware for communicating with external devices through communication channels such as USB (Universal Serial Bus), LAN (Local Area Network), and the Internet.

Figure 5:
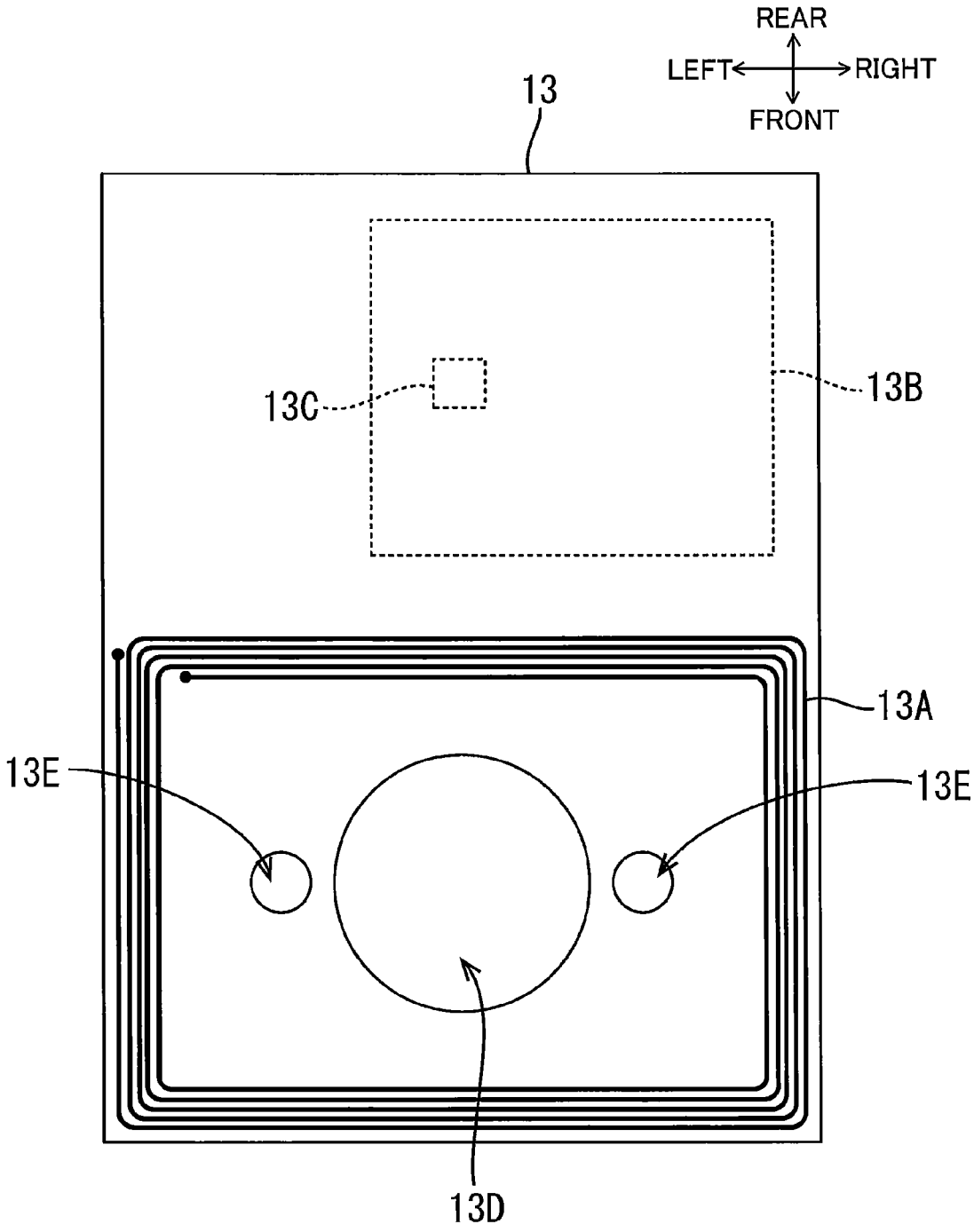
FIG. 5 is a plane view of a communication board.

Next, the communication board 13 will be described with reference to FIG. 5. The communication board 13 is for performing near field wireless communication. Components such as the loop-shaped antenna 13A for near field wireless communication, a communication circuit 13B that is electrically connected to the antenna 13A, and an LED 13C are surface-mounted on the communication board 13. The communication circuit 13B is a circuit for communicating with portable terminals using the antenna 13A. With the communication board 13 attached to the printer 1, the antenna 13A is mounted on an upper surface of the communication board 13, and the communication circuit 13B and the LED 13C are mounted on a lower surface of the communication board 13. The LED 13C is an example of a light source.

A first hole 13D and two second holes 13E are formed on an inner area of the loop-shaped antenna 13A on the communication board 13. The first hole 13D allows a light guide plate 55 to pass through the first hole 13D (see FIG. 7). At positions separated from the first hole 13D, two second holes 13E allows connecting members 51 (see FIG. 7) to pass therethrough. The light guide plate 55 and the connecting members 51 will be described below. Note that it is acceptable for the first hole 13D and the second holes 13E to be formed so as to be connected as a single hole.

(4) Relative Positions of the Touch Screen and the Antenna

Figure 6:
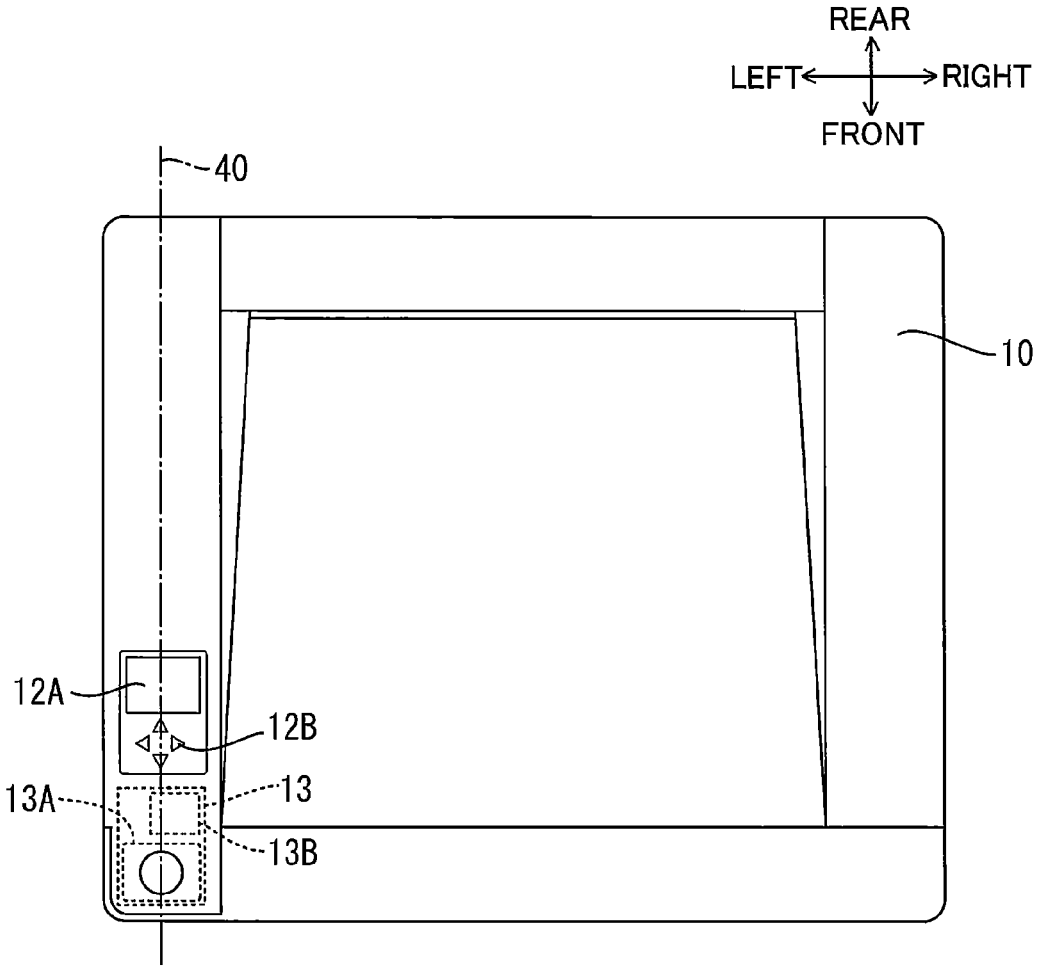
FIG. 6 is a diagram of a protruding portion of the printer viewed from above.

Next, the relative positions of the touch screen 12A and the antenna 13A will be described more specifically. FIG. 6 shows the housing 10 when viewed from above. Appearing in FIG. 6 is a straight line 40, which is an imaginary straight line extending in the frontward/rearward direction of the housing 10. As shown in FIG. 6, the touch screen 12A and the antenna 13A are disposed on the straight line 40.

Here, disposing the touch screen 12A and the antenna 13A being on the straight line 40 is not necessarily limited to the configurations in which a user can visually confirm the touch screen 12A and the antenna 13A from above the housing 10. For example, if the touch screen 12A and the antenna 13A are disposed on the straight line 40 when vertically projected on an imaginary horizontal plane, the antenna 13A and the touch screen 12A may be covered by an opaque cover and thus invisible to a user. Further, the antenna 13A may be positioned on the lower surface of the wall that forms the upper portion of the housing 10. Further, the surface of the wall may have an opening so that the antenna 13A is inserted and fixed in the opening.

Note that, in FIG. 6, a case is shown in which the center portion in a leftward/rightward direction of the touch screen 12A and the center portion in the leftward/rightward direction of the antenna 13A are both located on the straight line 40. However, the respective centers of these may not necessarily be located on the straight line 40. In other words, when viewed from above, at least a portion of the touch screen 12A may be located on the straight line 40 and at least a portion of the antenna 13A may be located on the straight line 40. Thus, it is acceptable for the center portion in the leftward/rightward direction of the touch screen 12A and the center portion in the leftward/rightward direction of the antenna 13A to be shifted in the leftward/rightward direction. Disposing the touch screen 12A and the antenna 13A such that the respective centers thereof in the leftward/rightward direction are located on the straight line 40 allows the width in the leftward/rightward direction of the end portion of the upper portion of the housing 10, except the opening/closing cover 11, on which the touch screen 12A and the antenna 13A are provided (in the present embodiment, the left end portion) to be made smaller, thus reducing the size of the printer 1.

Incidentally, as shown in FIG. 6, the communication board 13 is disposed further toward the front side than the touch screen 12A is. Specifically, starting at the front side of the housing 10 and progressing toward the rear side, the order in which components are disposed is: the antenna 13A, the communication circuit 13B, the operation buttons 12B, and the touch sensor (the touch screen 12A).

(5) Attachment Structure of the Communication Board

Figure 7:
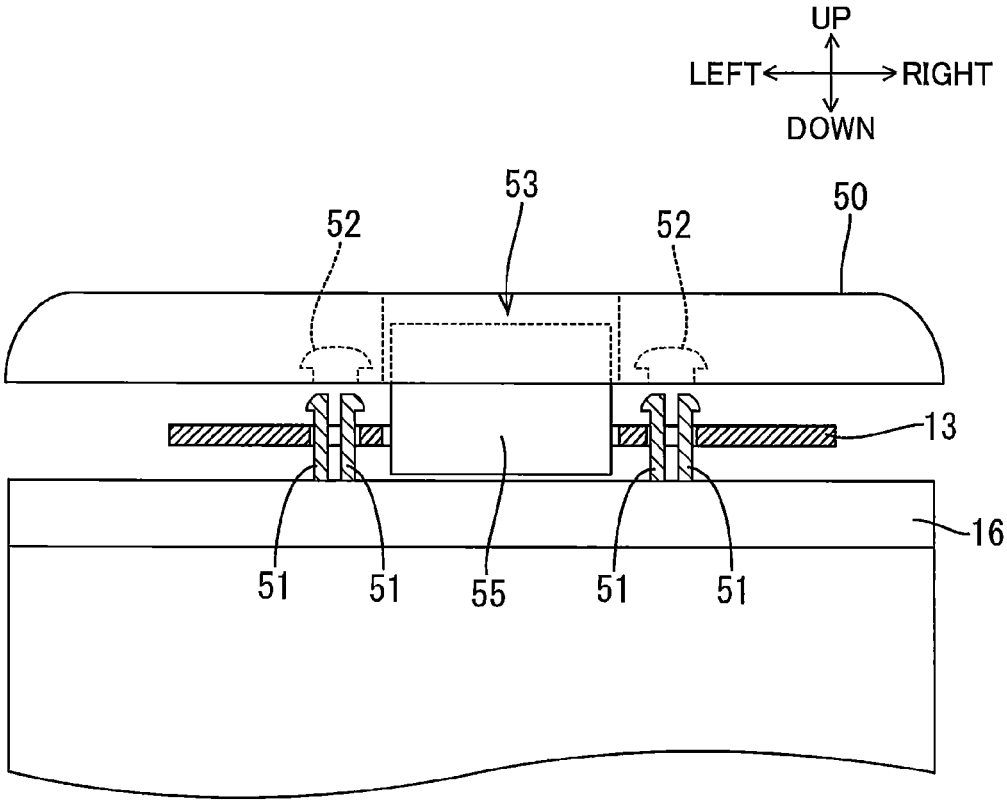
FIG. 7 is a cross-sectional view of the protruding portion and a peripheral area thereof viewed from the front side.

Next, the attachment structure of the communication board 13 will be described with reference to FIGS. 7 and 8. Note that in FIG. 7, a protective cover 50 is in the process of being attached. The communication board 13 is provided above the protruding portion 16, as shown in FIG. 7, with the upper side covered by the protective cover 50 made of resin. The protective cover 50 is provided in order to prevent the antenna 13A from being touched by a user and broken. The protective cover 50 is an example of a protective member and of a covering member.

Two connecting members 51 are fixed to the protruding portion 16 and extend upward. The connecting members 51 are provided in order to join the protruding portion 16 and the protective cover 50. The connecting members 51 are formed from an electrically non-conducting material. Note that the connecting members 51 may be integrally formed to the protruding portion 16, or may be formed as a separate part and fixed to the protruding portion 16 using screws or the like.

Each connecting member 51 has two column-shaped portions, which are mutually separated and which extend upward, and two hook portions, which are respectively provided on upper end portions of the two column-shaped portion and which face in mutually opposite directions. The column-shaped portions are resilient. Meanwhile, on the protective cover 50, holes 52 are formed which engage with the hook portions of the connecting members 51. Each of the holes 52 of the protective cover 50 has an upper portion and a lower portion, each of which has an inner peripheral surface. The inner diameter of the upper portion is wider than the inner diameter of the lower portion, resulting in a step surface between the respective inner peripheral surfaces of the upper and lower portions. The two connecting members 51 pass through the respective second holes 13E and are inserted into the respective holes 52 of the protective cover 50. As connecting members 51 are respectively inserted into the holes 52, the elastic column-shaped portions of the connecting member 51 bend, and the hook portions of the connecting member 51 enter the respective upper portions of the holes 52. The hook portions of the connecting members 51 then engage with the respective step surfaces of the holes 52, thereby undetachably joining the protective cover 50 to the protruding portion 16.

Note that it is acceptable for the connecting members 51 to be fixed to the protective cover 50. Configurations in which these connecting members 51 join with holes formed in the protruding portion 16 are also acceptable. Moreover, the connecting members 51 may alternatively be screws which join with the protective cover 50.

The light guide plate 55 is a substantially transparent member for guiding light from the LED 13C upward. On the protective cover 50, a hole 53 with a shape corresponding to the light guide plate 55 is formed. The light guide plate 55 is inserted into the hole 53 and is exposed upward.

Figure 8:
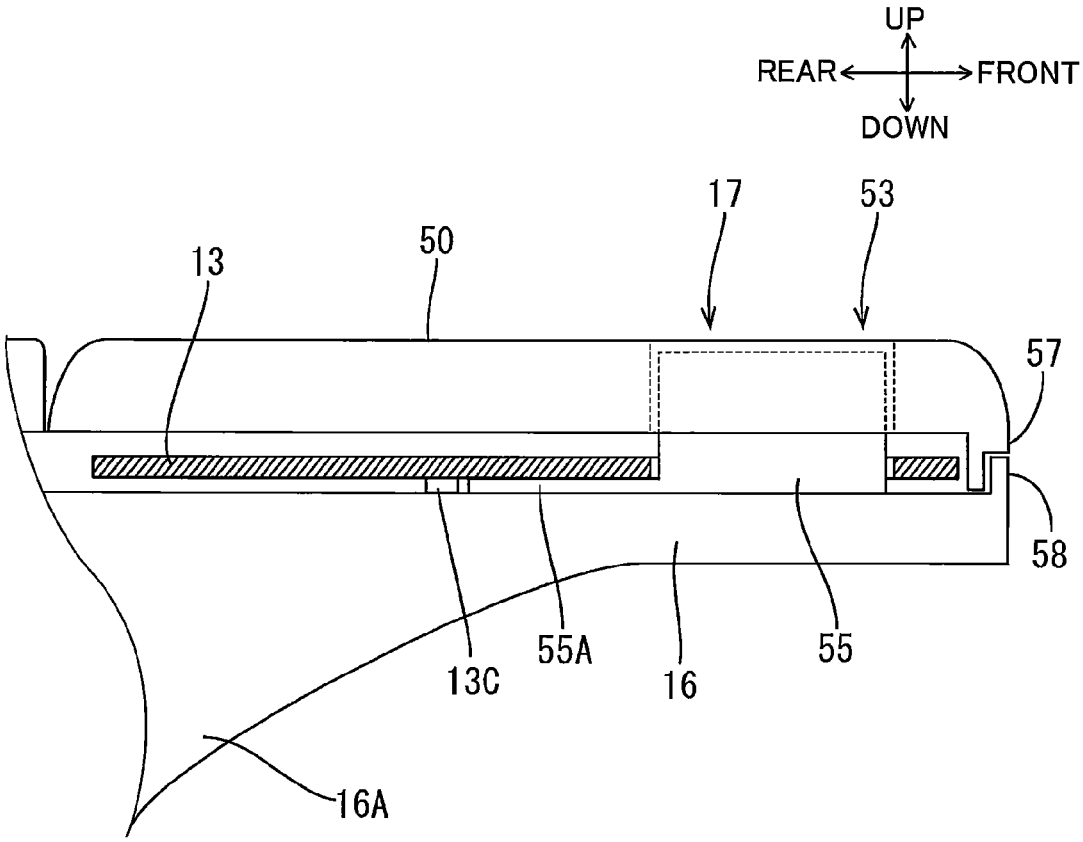
FIG. 8 is a cross-sectional view of the protruding portion and a peripheral area thereof viewed from the left side.

As shown in FIG. 8, the LED 13C described above is provided at the lower surface of the communication board 13. The light guide plate 55 has a bar-shaped portion 55A, which is fixed to the communication board 13 and has an end surface oriented to face the LED 13C. The portion 55A extends along the lower surface of the communication board 13 from the vicinity of the LED 13C to below the first hole 13D. Below the first hole 13D, the light guide plate 55 bends 90 degrees and extends upward in a cylindrical shape.

The light guide plate 55, having extended upward from below the first hole 13D, passes through the first hole 13D and is inserted into the hole 53 provided in the protective cover 50. As a result, when the LED 13C becomes lit, the area 17 at the inner side of the antenna 13A can be seen by the user as emitting light.

Note that the hole 53 is not necessarily to be formed if the protective cover 50 is formed using a transparent or translucent material. It is also acceptable to form the hole 53 into a shape which has a bottom and does not, when viewed from below, fully penetrate upward.

In addition, as shown in FIG. 8, walls are provided in order to increase the creepage distance between the protruding portion 16 and the protective cover 50, from the front of the housing 10 to the communication board 13. Specifically, an upper wall 57 that extends downward is provided at the front side of the protective cover 50. Meanwhile, a lower wall 58 that extends upward is provided at the front side of the protruding portion 16. A front side of a lower end portion of the upper wall 57 is formed into a shape which has a cut-out conforming to the shape of the lower wall 58. The creepage distance from the front of the housing 10 to the communication board 13 increases as a result of the meshing together of these two walls.

Note that the respective shapes of the upper wall 57 and the lower wall 58 are not limited to the shapes shown in FIG. 8. Any shapes may be utilized provided that the creepage distance becomes greater than would be the case if walls were not provided between the protruding portion 16 and the protective cover 50.

(6) Effect of the Embodiment

If the antenna 13A were disposed next to and further toward the rear side of the touch screen 12A, operational efficiency would decrease in that, when a user held a portable terminal near the antenna 13A, the touch screen 12A would become more susceptible to being covered up by, for example, the portable terminal, the user's hand, or a strap attached to the portable terminal.

Furthermore, if the antenna 13A were disposed next to and on the left side of the touch screen 12A, operational efficiency would be high for users accustomed to holding the portable terminal in the left hand and operating the touch screen 12A, and the operation buttons 12B provided in the vicinity of the touch screen 12A, with the right hand. However, for users accustomed to holding the portable terminal in the right hand, or users accustomed to operating the touch sensor and the operation buttons 12B with the left hand, the user's hands would tend to cross each other during operation, and the touch screen 12A would become more susceptible to being covered up. Further, even if the touchscreen 12A were not covered up, operational efficiency would still decrease if users not accustomed to this layout were to for instance hold a portable terminal and operate the touch sensor and the operation buttons 12B. Moreover, even if the antenna 13A were disposed next to and on the right side of the touchscreen 12A, operational efficiency would decrease in the same manner as if the antenna 13A were disposed next to and on the left side of the touchscreen 12A.

In contrast, based on the configuration of the printer 1 according to the first embodiment, the antenna 13A is disposed further toward the front side than the touch screen 12A. Accordingly, the decrease in operational efficiency that arises when the antenna 13A is disposed next to and on the rear side, left side, or right side of the touch screen 12A can be avoided.

In addition, based on the configuration of the printer 1, the antenna 13A and the touch screen 12A are disposed on the straight line 40 extending in the frontward/rearward direction of the housing 10, so the distance between the antenna 13A and the touch screen 12A in the leftward/rightward direction decreases. For this reason, users will not have to shift their line of sight widely in the leftward/rightward direction, so a decrease in operational efficiency resulting when users have to shift their line of sight widely in the leftward/rightward direction can be avoided.

As a result, based on the configuration of the printer 1, an image forming apparatus can be provided on which the touch screen 12A and the antenna 13A for near field wireless communication are disposed so that decreases in operational efficiency can be avoided.

In addition, based on the configuration of the printer 1, the touch screen 12A has a touch sensor that detects contact by an object. If the touch sensor is disposed further toward the front side than is the antenna 13A, there is a possibility that a user might, when holding a portable device to the antenna 13A, accidentally touch the touch sensor and thereby carry out unintentional operations. Based on the printer 1, the touch sensor is disposed further toward the rear side than is the antenna 13A, the possibility that a user might, when holding a portable device to the antenna 13A, accidentally touch the touch sensor can be suppressed.

In addition, based on the configuration of the printer 1, the communication board 13 and the touch sensor are aligned in the order as follows: the antenna 13A, the communication circuit 13B, and the touch sensor in straight line from the front side to the rear side of the housing 10. Disposing the antenna 13A and the touch screen too close to one another gives rise to the possibility of mutual interference and is thus not preferable. On the contrary, this alignment of the components in the printer 1 allows separated disposition of the antenna 13A and the touch sensor without wasting space, compared to the order: the circuit 13B, the antenna 13A, and the touch sensor. Furthermore, since the antenna 13A is disposed further frontward of the printer 1, operational efficiency is improved.

In addition, based on the configuration of the printer 1, the communication board 13 and the touch sensor are aligned in the order as follows: the antenna 13A, the operation buttons 12B, and the touch sensor in straight line from the front side to the rear side of the housing 10. Disposing the antenna 13A and the touch screen too close to one another gives rise to the possibility of mutual interference and is thus not preferable. On the contrary, this alignment of the components in the printer 1 allows separated disposition of the antenna 13A and the touch sensor without wasting space, compared to the order: the operation buttons 12B, the antenna 13A, and the touch sensor. Furthermore, since the antenna 13A is disposed further frontward of the printer 1, operational efficiency is improved.

In addition, the front cover 15 includes the upper surface portion 15C, and the upper surface portion 15C is formed so as to avoid interference with the antenna 13A when the front cover 15 is closed. Accordingly, the antenna 13A can be disposed further toward the front side compared to configurations in which the upper surface portion 15C is not formed so as to avoid the antenna 13A.

In addition, based on the configuration of the printer 1, the antenna 13A is disposed at the protruding portion 16, so the antenna 13A can be disposed at the front side even if the front cover 15 includes the upper surface portion 15C.

In addition, based on the configuration of the printer 1, the protective cover 50 is provided to cover the antenna 13A, so the antenna 13A provided at the protruding portion 16 can be protected.

In addition, based on the configuration of the printer 1, the connecting members 51, which join the protruding portion 16 and the protective cover 50, pass through the area on the inner side of the loop-shaped antenna 13A, so the area at the inner side of the antenna 13A can be utilized effectively.

In addition, based on the configuration of the printer 1, the connecting members 51 and the light from the LED 13C are passed through the area on the inner side of the loop-shaped antenna 13A, so the area at the inner side of the antenna 13A can be utilized effectively.

In addition, based on the configuration of the printer 1, the connecting members 51 are formed from an electrically non-conducting material. If the connecting members 51 were formed from an electrically conducting material, there is a risk that the electromagnetic waves radiated from the antenna 13A would be affected by the connecting members 51, and near field wireless communication would be obstructed. By forming the connecting members 51 from an electrically non-conducting material, obstruction of near field wireless communication can be prevented.

In addition, based on the configuration of the printer 1, the upper wall 57 and the lower wall 58 are provided in order to increase the creepage distance between the protruding portion 16 and the protective cover 50, from the front of the housing 10 to the communication board 13. If a user's hand touches the antenna 13A with holding a portable device over the antenna 13A, static electricity can arise, and this static electricity may cause damage to the communication board 13. By providing the upper wall 57 and the lower wall 58 and increasing the creepage distance, damage to the communication board 13 by this sort of static electricity can be prevented.

Second Embodiment

Figure 9:
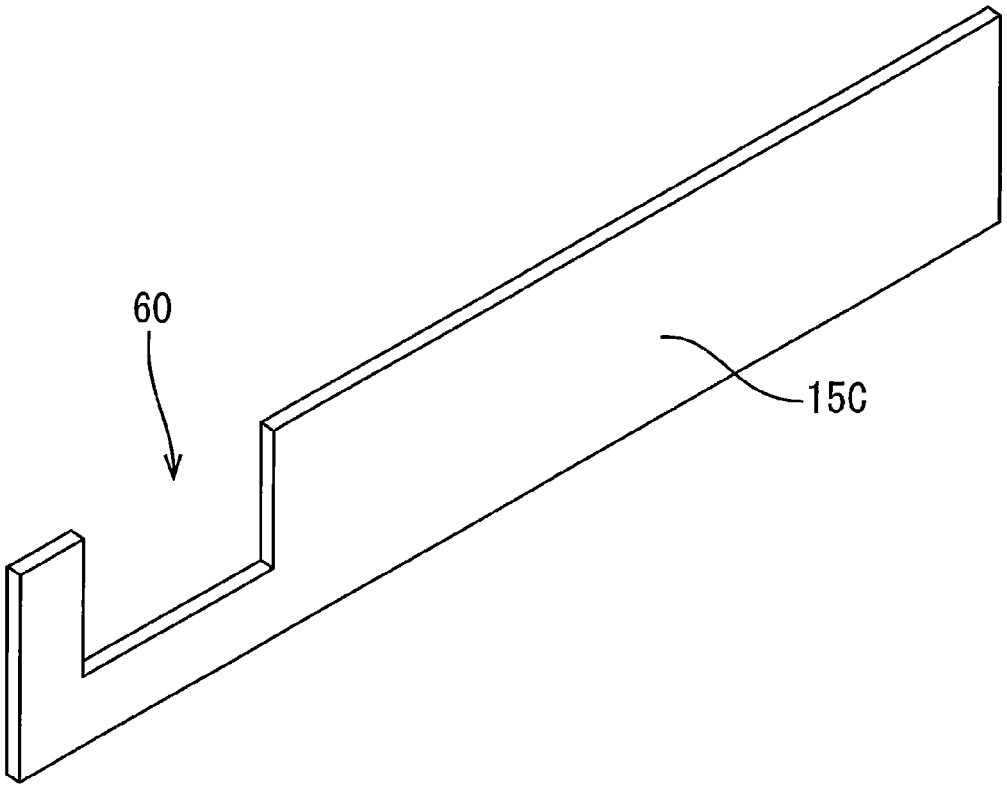
FIG. 9 is a perspective view of an upper surface portion according to a second embodiment.

Next, a second embodiment of the present invention will be described with reference to FIG. 9.

According to the previously described first embodiment, the upper surface portion 15C is formed into a shape which is missing an area on the left side conforming to the shape of the protruding portion 16. In contrast, it is also acceptable to make the width of the upper surface portion 15C in the leftward/rightward direction substantially identical to the width of the housing 10 in the leftward/rightward direction, and form a recessed portion 60 at a side of the upper surface portion 15C which becomes a rear side when the front cover 15 is closed, as shown in FIG. 9. If the upper surface portion 15C is formed into this shape, the left wall 15A provided at the left edge of the front cover 15 and the right wall 15B provided at the right edge of the front cover 15 will be connected by the upper surface portion 15C, so the strength of the front cover 15 can be increased.

Other Embodiments

While the present invention has been described in detail with reference to the embodiments thereof, it would be apparent to those skilled in the art that various changes and modifications may be made therein without departing from the spirit of the invention.

(1) For the embodiments presented above, examples were described in which there are no differences in level at the upper portion of the housing 10; that is, the housing 10 constituting a single surface at a single level. However, it is acceptable, in contrast, for differences in level to be provided on the housing 10; that is, the housing 10 to include multiple surfaces at multiple levels. In such cases, from among the multiple surfaces forming the housing 10, the antenna 13A and the touch screen 12A may be provided either at the same surface or at different surfaces. In other words, provided that the antenna 13A and the touch screen 12A are both disposed at the upper portion of the housing 10, there may be a difference in level between the surface at which the antenna 13A is disposed and the surface at which the touch screen 12A is disposed.

(2) For the embodiments presented above, examples were described in which the housing 10 includes the front cover 15. However, configurations in which, the housing 10 does not include the front cover 15 are also acceptable. In such cases, the protruding portion 16 need not be provided.

Moreover, the protruding portion 16 need not be provided even if the housing 10 does include the front cover 15. In such cases, the antenna 13A may be disposed further toward the rear side than the upper surface portion 15C of the front cover 15.

(3) For the embodiments presented above, examples were described in which the antenna 13A and the touch screen 12A are disposed at the left side of the housing 10. Alternatively, configurations in which, the antenna 13A and the touch screen 12A are disposed at the right side of the housing 10, or are disposed at the front side of the opening/closing cover 11 if space permits, are also acceptable.

(4) For the embodiments presented above, examples were described in which the touch screen 12A includes the touch sensor. However, configurations in which, the touch screen 12A does not include the touch sensor are also acceptable.

(5) For the embodiments presented above, examples were described in which the antenna 13A and the communication circuit 13B are mounted on the same board. Alternatively, configurations in which, the antenna 13A and the communication circuit 13B are mounted on different boards are also acceptable.

(6) For the embodiments presented above, the protective cover 50 is presented as an example of a protective member. Alternatively, the protective member may instead be a resin mold.

(7) For the embodiments presented above, examples were described in which the upper surface portion 15C is not covered by other members. Alternatively, configurations in which, the upper surface portion 15C, including the area above the antenna 13A, is covered by a transparent or translucent member such as smoky material are also acceptable.

(8) For the embodiments presented above, examples were described in which the rear side of the upper surface portion 15C is covered by sheet metal. Alternatively, configurations in which, sheet metal is attached to the rear side of the upper surface portion 15C for strength reinforcement are also acceptable.

(9) For the embodiments presented above, the printer 1 is presented as an example of an image forming apparatus. Alternatively, the image forming apparatus may instead be a so-called multifunction device which includes, for example, printing capability, scanning capability, copying capability, and facsimile (faxing) capability, or may be a single-function image scanner or a single-function facsimile device.

(10) For the embodiments presented above, examples were described in which processes are executed the CPU 30A. Alternatively, configurations in which, some of these processes are executed by the ASIC 30D are also acceptable. Furthermore, configurations in which the ASIC 30D is not included are also acceptable. Moreover, the control unit 30 may include multiple CPUs and apportion the execution of the processes mentioned above among the multiple CPUs.

What is claimed is:

1. An image forming apparatus comprising:

a housing having an upper end portion, a front end portion, and a rear end portion, the front end portion and the rear end portion defining a frontward/rearward direction;

a sheet tray attached to the housing and drawable frontward from the front end portion, the sheet tray being configured to accommodate a sheet;

an image forming unit disposed in the housing and configured to print an image on the sheet supplied from the sheet tray;

a communication board provided on the upper end portion and comprising an antenna for near field wireless communication; and a display device provided on the upper end portion, the display device and the antenna being arrayed on a straight line extending in the frontward/rearward direction such that the antenna is positioned frontward of the display device, wherein the housing further comprises a discharge port configured to discharge frontward therefrom the sheet on which the image has been formed in a discharging direction parallel to the straight line, wherein the upper end portion has a part serving as a receiving portion configured to accommodate the sheet discharged from the discharge port, the display device and the antenna being provided on the upper end portion other than the receiving portion, and wherein the antenna is positioned frontward of the discharge port.

2. The image forming apparatus according to claim 1, wherein the display device comprises a touch sensor configured to detect physical contact of an object.

3. The image forming apparatus according to claim 2, wherein the communication board further comprises a communication circuit electrically connected to the antenna; and wherein the antenna, the communication circuit, and the touch sensor are arrayed in this order on the straight line from the front end portion to the rear end portion.

4. The image forming apparatus according to claim 2, further comprising an operation button; and wherein the antenna, the operation button, and the touch sensor, are arrayed in this order on the straight line from the front end portion to the rear end portion.

5. The image forming apparatus according to claim 1, wherein the front end portion of the housing comprises a front cover movable between an open position and a closed position, in the closed position the front cover including a front wall having an upper wall portion extending from the upper end portion toward the rear end portion, the upper wall portion having a shape capable of avoiding mechanical interference with the antenna at the closed position of the front cover.

6. The image forming apparatus according to claim 5, wherein the housing has a protruding portion protruding frontward of the housing; and wherein the antenna is disposed on the protruding portion.

7. The image forming apparatus according to claim 6, further comprising a protective member covering the antenna.

8. The image forming apparatus according to claim 7, wherein the protective member is a covering member covering the antenna;

wherein the antenna has an inner area; and wherein the image forming apparatus further comprises a connecting member extending through the inner area to connect the protruding portion to the covering member.

9. The image forming apparatus according to claim 8, wherein the inner area has a first hole allowing a light from a light source to pass therethrough, and a second hole offset from the first hole, the connecting member extending through the second hole.

10. The image forming apparatus according to claim 8, wherein the connecting member is formed from an electrically non-conductive material.

11. The image forming apparatus according to claim 8, further comprising a wall positioned between the protruding portion and the covering member to elongate a creepage distance from the front end portion of the housing to the communication board.

12. The image forming apparatus according to claim 1, wherein the display device is positioned frontward of the discharge port.

13. The image forming apparatus according to claim 1, wherein the housing is formed with an opening; and wherein the receiving portion is a cover configured to open and close the opening.

14. The image forming apparatus according to claim 13, wherein the image forming unit comprises a storing portion storing one of toner and ink, the storing portion being attachable to and detachable from the housing when the cover opens the opening.

15. The image forming apparatus according to claim 1, further comprising a front cover connected to the front end portion of the housing and configured to pivot frontward.

16. The image forming apparatus according to claim 15, wherein the front cover is configured to accommodate the sheet in a state where the front cover has pivoted frontward.

17. The image forming apparatus according to claim 1, wherein the antenna has a loop shape and is mounted on an upper surface of the communication board.

18. An image forming apparatus comprising:

a housing having an upper end portion, a front end portion, and a rear end portion, the front end portion and the rear end portion defining a frontward/rearward direction;

a sheet tray attached to the housing and drawable frontward from the front end portion, the sheet tray being configured to accommodate a sheet;

an image forming unit disposed in the housing and configured to print an image on the sheet supplied from the sheet tray;

a communication board provided on the upper end portion and comprising an antenna for near field wireless communication; and a display device provided on the upper end portion, the display device and the antenna being arrayed on a straight line extending in the frontward/rearward direction such that the antenna is positioned frontward of the display device, wherein the antenna has a loop shape and is mounted on an upper surface of the communication board;

wherein the housing further defines a rightward/leftward direction perpendicular to the frontward/rearward direction; and wherein each of the antenna and the display device has a center portion in the rightward/leftward direction positioned on the straight line.

* * * * *